US005373762A

United States Patent [19]

Kato

[11] Patent Number: 5,373,762

[45] Date of Patent: Dec. 20, 1994

[54] METHOD OF CUTTING LABEL TAPES

[75] Inventor: Katsuyuki Kato, Nagoya, Japan

[73] Assignee: Kabushikikaisha Barudan, Japan

[21] Appl. No.: 15,979

[22] Filed: Feb. 10, 1993

[30] Foreign Application Priority Data

Feb. 14, 1992 [JP] Japan ..... 4-061250

[51] Int. Cl.[5] ..... D05B 3/22; B26D 5/32

[52] U.S. Cl. ..... 83/42; 83/209; 83/367; 83/371; 112/130

[58] Field of Search ..... 83/13, 42, 63, 209, 83/367, 371; 112/130

[56] References Cited

U.S. PATENT DOCUMENTS

| | | | |
|---|---|---|---|
| 3,822,624 | 7/1974 | Shoji et al. | 83/371 X |
| 4,221,144 | 9/1980 | Diesch et al. | 83/371 X |
| 4,436,008 | 3/1984 | Strunc | 83/371 X |
| 4,466,316 | 8/1984 | Kobayashi et al. | 83/13 |
| 4,737,904 | 4/1988 | Ominato | 83/371 X |
| 4,781,090 | 11/1988 | Feldkamper et al. | 83/371 X |
| 5,072,639 | 12/1991 | Dolf | 83/371 X |
| 5,120,290 | 6/1992 | Bay | 83/371 X |
| 5,235,515 | 8/1993 | Ungpiyakul et al. | 83/371 X |

FOREIGN PATENT DOCUMENTS

| | | | |
|---|---|---|---|
| 28786 | 3/1977 | Japan | 83/371 |
| 2186226 | 8/1987 | United Kingdom | 83/371 |

*Primary Examiner*—Rinaldi I. Rada
*Assistant Examiner*—Clark F. Dexter
*Attorney, Agent, or Firm*—William A. Drucker

[57] ABSTRACT

A method by which when a long label tape is cut at a number of cut marks made thereon into a number of labels, the cut marks can be reliably confirmed. The long label tape is advanced in its longitudinal direction, a cut mark is confirmed, and the tape is cut at the cut mark. The cut mark is confirmed by a combination of a first step of confirming that a front side margin of the cut mark arrives at a detecting position and a subsequent second confirmation step of confirming that the cut mark arrives at the detecting position.

6 Claims, 7 Drawing Sheets

METHOD OF CUTTING LABEL TAPES

BACKGROUND OF THE INVENTION

1. Field of the Invention

This invention relates to a method of cutting a label tape into a number of labels at cut marks made on the label tape.

2. Description of the Prior Art

The above mentioned label tape is very long. In general, it is wound in the form of a roll. The long label tape is formed, for example, by connecting many woven label tape elements one after another. On each label tape element, many cut marks are made beforehand at intervals corresponding to a prescribed label length. An indication area and adjacent margin regions are provided between cutting marks for adjacent labels. A brand name and quality are indicated at arbitrary places within the indication area.

The operation to cut the long label tape and produce a large number of labels is done as follows. A prescribed advance route of the labels is determined and a sensor to detect the cut marks and a cutter to cut the label tape are arranged along the route. In a first process, the front end portion of the above mentioned long label tape is fed a certain distance along the route and a confirmation of the cut mark is carried out by confirming a detecting signal by said sensor. If the cut mark is confirmed, the label tape is further fed by the distance between the cutter and the sensor in a second step. Further in a third step the label tape is cut by the cutter. These first through third steps are repeated one after another. The prior art of this type is well known, for example, U.S. Pat. No. 5,040,472.

According to the above mentioned prior art, the label tape can be accurately cut at cut marks one after another and a large number of regular labels can be produced if the spacing of the cut marks is constant.

If a number of label tape elements are improperly connected in producing the long label tape or if the label tape element is miswoven, the spacing between adjacent cut marks may be shorter or longer at some part of the tape. In the operation including the above mentioned first through third steps when that portion of the label tape which does not have the front side margin of the cut mark and, therefore, is formed at a shorter spacing due to the above mentioned irregularity of the spacing arrives at the position of the sensor, the cut mark will have passed the sensor in the above mentioned first step to feed the label tape a certain distance. Accordingly, the sensor will find a cut mark at the indication area behind the above mentioned cut mark. If any indication is present in the indication area and the indication is one such as "E" or "L", similar to the cut mark, this indication is confirmed by mistake as the cut mark according to the prior art. Thus the second and the third steps are carried out on the basis of the indication detected by mistake and the label tape will be cut at a wrong position. Thereafter, in the repetition of the first through third steps, the label tape is cut at wrong positions in succession and presents a problem of producing a large number of inferior labels. This leads especially to a serious problem that when the labels produced by cutting the label tape are automatically sewn one after another, for example, on clothes in a succeeding operation, the clothes are inferior due to the inferior labels sewn on them.

SUMMARY OF THE INVENTION

The present invention solves the problems in the above mentioned prior art and an object of the present invention is to provide a method of cutting label tapes by which cutting the long label tape at wrong positions can be prevented and goods such as clothes with produced labels sewn thereon can be prevented from being made inferior.

According to the present invention, the long label tape can be accurately cut at cut marks in succession and the present invention has an effect to produce a large number of adequate labels having regular sizes.

Furthermore, in the present invention, the cut mark is confirmed by the combination of at least two operations such as confirming that a front side margin of prescribed length arrives at a detecting position and then confirming the cut mark of prescribed length. The present invention has an effect that even when part of the label tape without the front side margin of the cut mark as mentioned above or with a longer (or shorter) indication area arrives, such abnormality can be judged at once, a signal to inform of a problem can be rendered, and a remedial measure, such as stopping the cutting work due to the received signal can be taken.

Figure 6A:
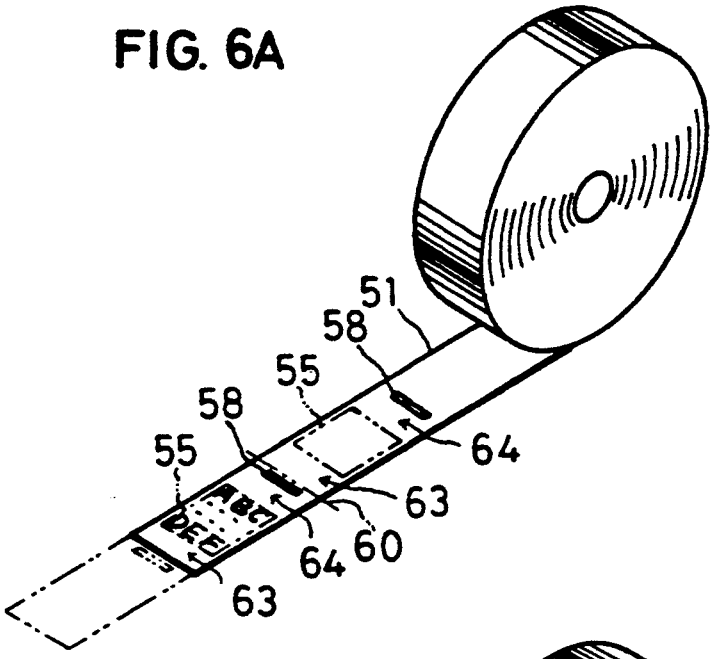
Figure 6B:
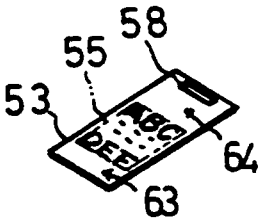
Figure 6C:
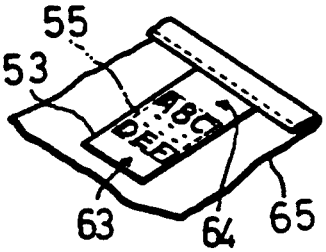
Figure 6E:
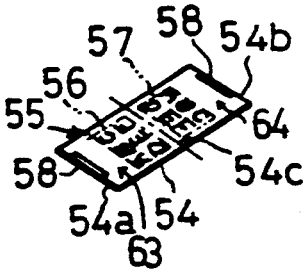
Figure 6D:
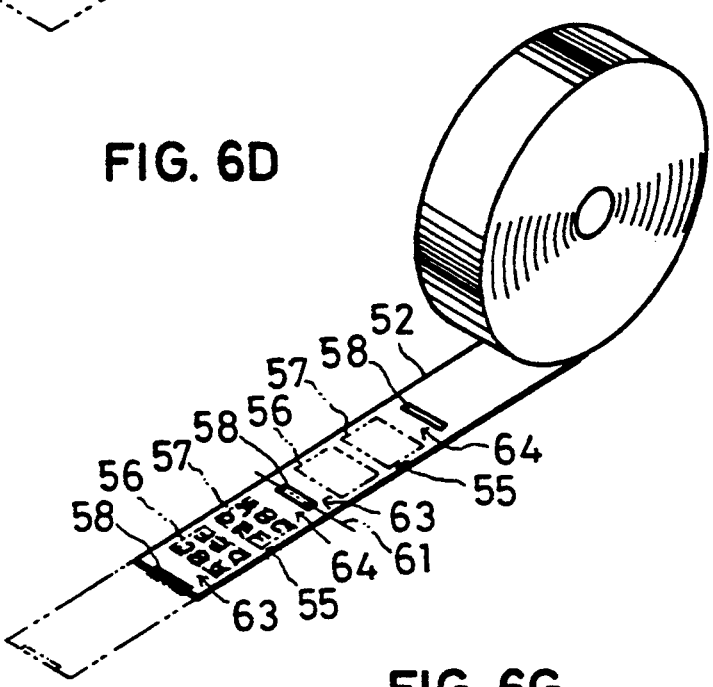
Figure 6F:
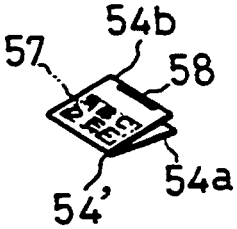
Figure 6G:
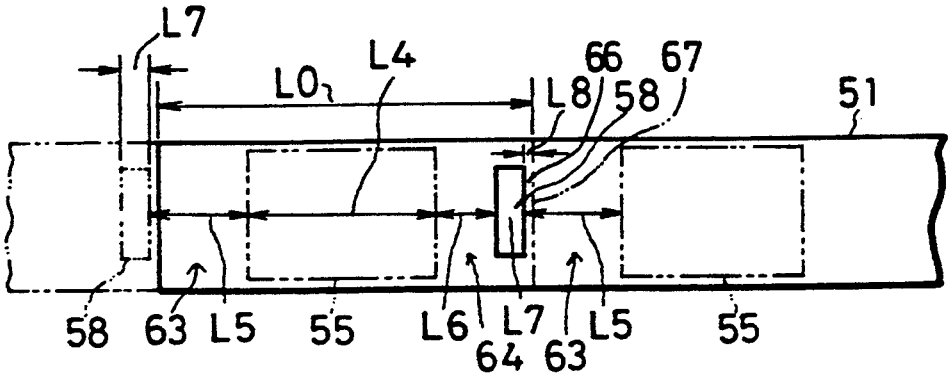
Figure 7:
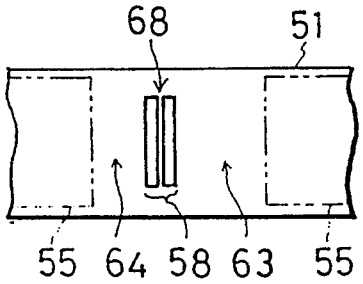
Figure 9:
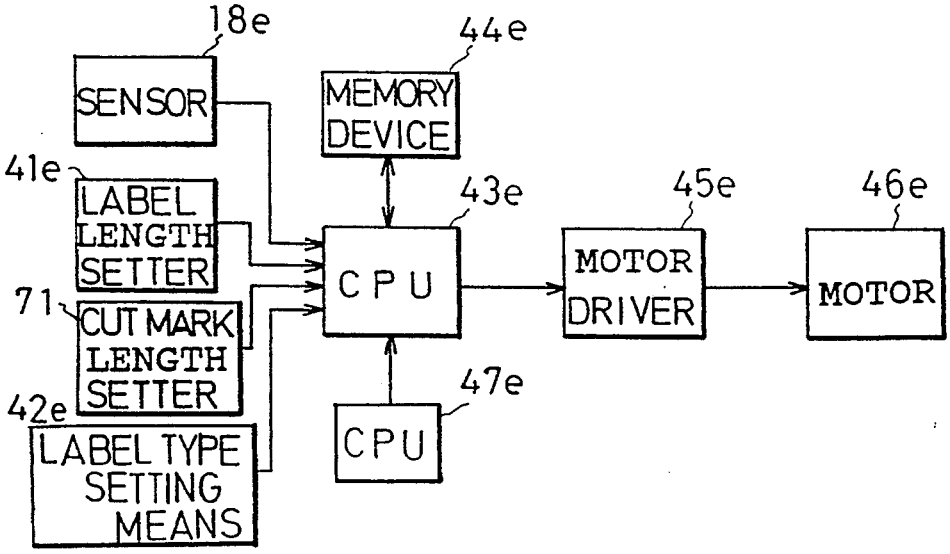
Figure 10:
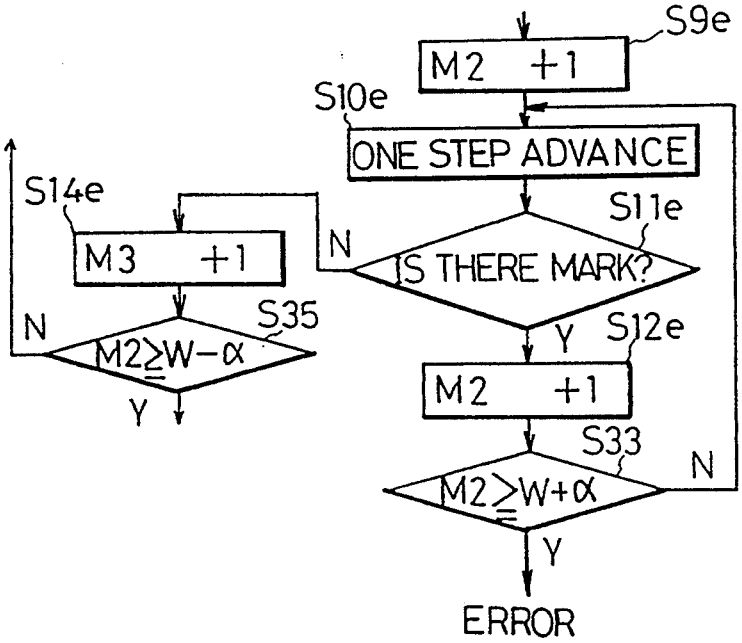

Figs, 6A through 6F are perspective views showing label tapes and labels, FIG. 6G being a plan view of the label tape;

FIG. 7 is a view showing a flawed cut mark;

FIGS. 8A through 8F are views showing label tapes having respective abnormal portions;

FIG. 9 is a block diagram showing a different example of the control apparatus and FIG. 10 is a partial flow chart showing a different example of control.

DESCRIPTION OF THE PREFERRED EMBODIMENTS

In reference with drawings, embodiments of the present invention are described. First in reference with FIGS. 6A through 6G, labels and label tapes are explained. There is a single label 53 as shown in FIG. 6B and a folded label 54' as shown in FIG. 6F. The single label 53 is formed from a long label tape 51 as shown in FIG. 6A. A number of cut marks 58 are made on the label tape 51 at equal intervals along the longitudinal direction of the tape and between adjacent front and rear cut marks 58 and 58 there is provided an indication area 55 together with margins 63 and 64 to respective cut marks 58 and 58. A brand name, quality or the like are indicated in the indication area 55. The single label 53 is formed by cutting the label tape 51 of this type at a position shown by reference numeral 60 behind each cut mark 58 so that the cut mark may be left only on one end of the single label 53. The cut label 53 is sewn on clothes 65 so that the remaining cut mark 58 may be hidden as shown in FIG. 6C. The width of the label 53 is, for example, 20 mm (other width being 15~50 mm) and the length of it is, for example, 50 mm (other length being 15~60 mm). On the other hand, the folded label 54' is formed by cutting a label tape 52 as shown in FIG. 6D at the center position 61 of each cut mark 58 into label elements 54 as shown in FIG. 6E. The cut label element 54 is folded in two at the middle 54c between one end 54a and the other end 54b of the label element 54 as shown in FIG. 6F and the folded label 54' is formed. The overlapped one end 54a and the other end 54b of the folded label 54' is sewn on clothes in the same manner as in the case of FIG. 6C. The indication area 55 includes area elements 56 and 57 appearing on one and the other sides of the label folded in two. The width of the folded label 54' is, for example, 40 mm (other width being 15~50 mm) and its length is, for example, 40 mm (length range being 30~50 mm). In FIG. 6G, 66 represents a portion to be left behind the cut mark 58 in the case of cutting of the single label 53, 67 is a portion to be cut, L0 is the length of one label, L4 the length of the indication area 55, L5 the length of the margin 63, L6 is the length of the margin 64, L7 is the length of the cut mark 58, and L8 is the length of the portion to be left behind 66.

Figure 1:
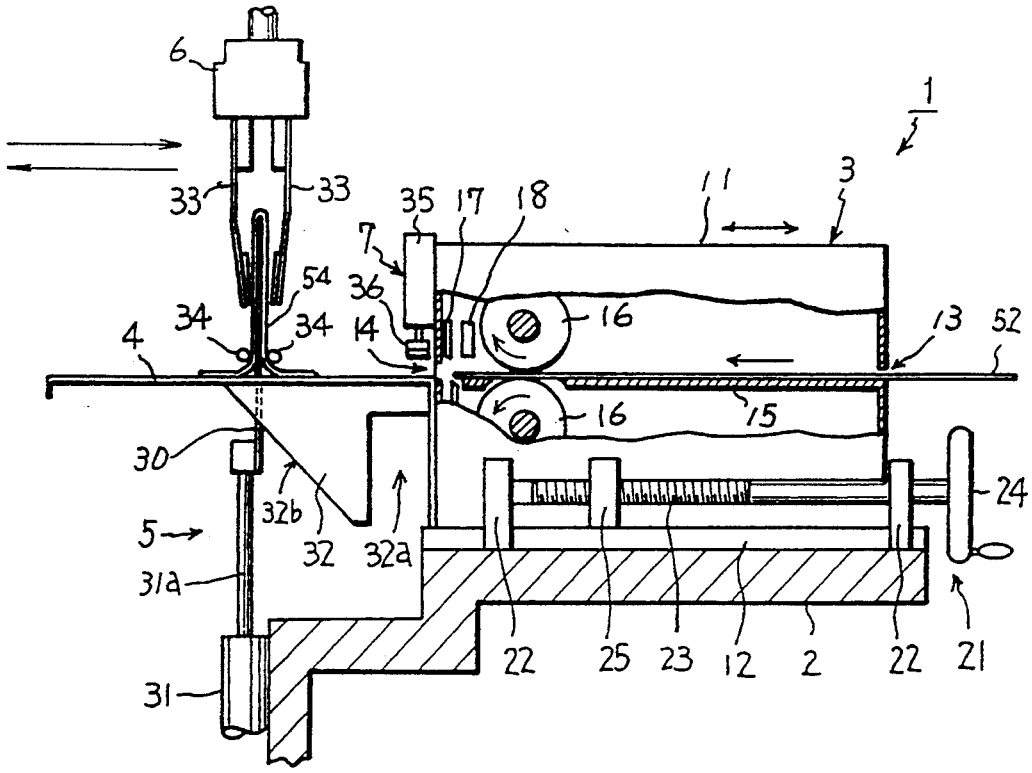
FIG. 1 is a side elevation in partial section of a label supply equipment.

Now, a label supply equipment 1 adapted to form and feed the above mentioned labels is described with reference to FIG. 1. The label supply equipment 1 includes a base frame 2, a cutting apparatus 3 mounted on the base frame 2, a label table 4 with an upper surface thereof formed to be a label disposition place to put a label thereon, a label forcing apparatus 5 provided under the label table 4, a conveyer 6 provided over the label table 4 and a restraint apparatus 7 adapted to restrain part of the label on the label table 4.

The above mentioned cutting apparatus 3 has a function to cut the long label tape 51 or 52 into labels and a function to prepare the cut labels on the label table 4. The cutting apparatus 3 is now explained. A housing 11 of the cutting apparatus 3 is provided for movement in the direction shown by an arrow in FIG. 1 along a rail 12 fixed on the base frame 2. The housing 11 is formed with an inlet 13 for the label tape at one side thereof and an outlet 14 at the other side thereof. The housing 11 includes therein, between the inlet 13 and the outlet 14, a support plate 15 to receive the label tape and to determine its advance route. Inside the housing 11 is provided a means to advance the label tape such as a pair of feed rollers 16. These feed rollers 16 with the label tape sandwiched therebetween are rotated in the direction of an arrow by a driving motor to be mentioned later. The rotated rollers 16 pull in the label tape through the inlet 13 and send out it through the outlet 14. A cutter 17 to cut the label tape is provided along the advance route of the label tape near the outlet 14 inside the housing 11. A sensor 18 to detect the cut mark is provided along the advance route of the label tape at a position apart from the cutter 17 toward the rear side of the advance route of the label tape. The sensor 18 is, for example, a sensor to perceive optically the presence of the cut mark.

A shifter 21 is provided for the purpose of moving the housing 11 along the rail 12. The shifter 21 comprises a pair of bearings 22 and 22 fixed on the base frame 2, a feed rod 23 supported rotatably by these bearings 22 and 22, a handle 24 to rotate the feed rod 23 and a mover 25 fixed on the housing 11. The feed rod 23 is, for example, a threaded rod and is in mesh with a threaded hole formed in the mover 25. When the feed rod 23 is rotated by the handle 24, the mover 25 is shifted along the feed rod 23 and, consequently, the housing 11 is shifted along the rail 12.

The above mentioned label table 4 is mounted on the housing 11 of the cutting apparatus 3 in such a manner that it can receive the label tape sent out through the outlet 14 to whatever position the housing 11 may be shifted and is adapted to be shifted together with the housing 11 by the shifter 21. The label forcing apparatus 5 comprises a forcing piece 30 and a reciprocating apparatus 31 to move the forcing piece 30 back and forth. The forcing piece 30 is adapted to move up and down in the direction perpendicular to the upper surface of the table 4 through a slit formed in the table 4. An air cylinder mounted on the base frame 2 is use as an example of the reciprocating apparatus 31. The above mentioned forcing piece 30 is attached to the free end of a piston rod 31a of the air cylinder. A control piece 32 mounted on the table 4 is adapted to control the rising height of the forcing piece 30 and includes a control surface 32b inclined at an angle, for example, of 45°. The aforementioned conveyer 6 is moved back and forth by a drive apparatus (not shown) in the directions shown by arrows between a holding position (a position directly over the forcing piece 30) in FIG. 1 and a sewing position (not shown). The conveyer 6 includes a pair of holding pieces 33 and 33 and is adapted to hold the label raised by the forcing piece 30. A label guide 34 is provided close to the label table 4. The label guide 34 is fixed at the base frame 2, although the detail of fixing is not shown in FIG. 1. The aforementioned restraint apparatus 7 comprises, for example, an air cylinder 35 mounted on the housing 11 of the cutting apparatus 3 and a press piece 36 attached to the free end of a piston rod of the air cylinder 35.

The operation of the label supply equipment 1 is now explained. First, the supply of the folded label 54' as shown in FIG. 6F is explained. The cutting apparatus 3 and the label table 4 are moved by the shifter 21 so that the separation between the cutter 17 and the forcing piece 30 may be half the length of the folding label element 54 (the length of the folded label 54'). In this situation, the feed rollers 16 are operated by the control to be described later in detail and the label tape 52 is sent out toward on the label table 4. The label tape is then pressed by the press piece 36 of the restraint apparatus 7 onto the label table 4. In this situation, the cutter 17 operates. As a result, one label element 54 is cut off from the label tape 52. Then the pressing operation by the press piece 36 is eliminated. Next, the label element 54 is folded in two and the label 54' is formed. Namely, the piston rod of the cylinder 31 is extended. The forcing piece 30 is then raised and forces the center of the label on the label table 4 (a folded position shown by 54c in FIG. 6E) between the holding pieces 33 and 33 through the gap of the label guide 34. Then the forced label is elastically held by the holding pieces 33 and 33. Next, the forcing piece 30 is retracted by the contracting cylinder 31. In this manner, the label element 54 is formed into the folded label 54'. Next, the conveyer 6 is moved by the drive apparatus to the sewing position. The conveyer 6 releases the label 54' and is then returned to the holding position. The conveyed label 54' is sewn at; the sewing position in a well known manner.

Next the supply of the single label 53 as shown in FIG. 6B is explained. The cutting apparatus 3 and the label table 4 are shifted by the shifter 21 so that a notch portion 32a of the control piece 32 may face the forcing piece 30. In this situation, the label tape 51 is advanced similarly as in the above mentioned case and is cut. Then the forcing piece 30 is raised with the press piece 36 pressing the rear end portion of the cut single label, and the front end portion of the cut single label is forced between the holding pieces 33 and 33. Next, the holding piece 36 releases the label and the subsequent operation is performed similarly to the case of the folding label.

Figure 2:
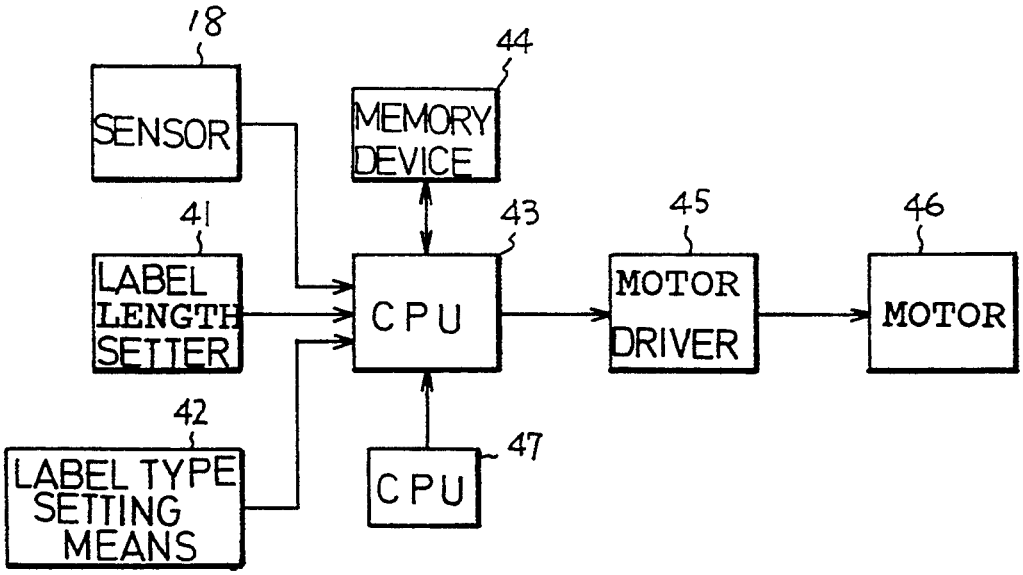
FIG. 2 is a block diagram showing a control apparatus for a cutting apparatus.

Next the control apparatus for the cutting apparatus 3 is explained with reference to FIG. 2. A label length setter 41 is adapted to set beforehand the length of a label to be cut (the single label 53 or the label element 54) and is, for example, a digital switch. A label type setting means 42 is adapted to determine whether a label to be cut is a single label or a folded label and is, for example, a change-over switch. Numerals 43, 44 and 45 represent a CPU, a memory device and a motor driver, respectively and 46 represents a motor such as a stepping motor to rotate the rollers 16. Numeral 47 represents a CPU to control the operation of an apparatus to receive supplied labels, such an apparatus called a hemming machine, to fold a towel into three and sew it.

Figure 3:
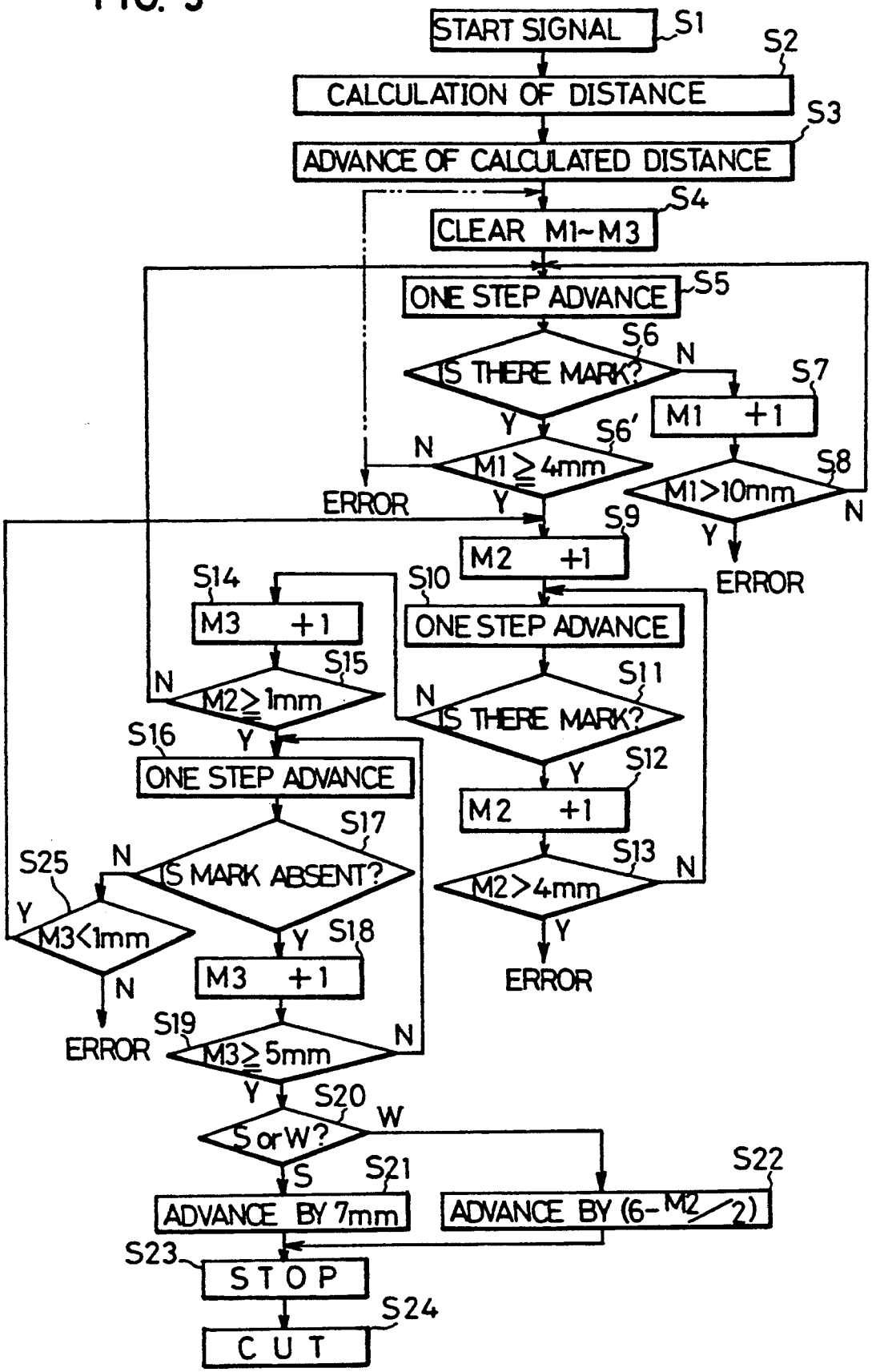
FIG. 3 is a flow chart showing the control by the control apparatus.

Next the operation of the cutting apparatus 3 is explained with reference to FIG. 3. First, the cutting operation of the single label 53 is explained with reference to FIGS. 4A through 4G. The length of the single label is set beforehand in the label length setter 41 and the change-over switch 42 is turned to the single label side. A start signal is received from the CPU 47 in a step S1. Then, in a step S2, a distance is computed by which the label tape 51 is advanced unconditionally. The unconditional advance performed in order that the label tape 51 is moved until the indication area 55 passes a detecting position 18*a*. First, the distance (for example 11 mm) corresponding to the length L1 between a cutting position 17*a* of the cutter 17 and the detecting position 18*a* of the sensor 18, the length L6 (for example 8 mm) of the front side margin 64 of the cut mark the length L7 (for example 4 mm) of the cut mark 58 and the length L8 (for example 1 mm) of the portion 66 to be left behind the cut mark 58 are subtracted from the label length (for example 50 mm) and set in the label length setter 41 while 1 mm is added to the result of the above subtraction as a margin for making sure that the indication area 55 passes the detecting position 18*a*. For example, 27 mm is obtained as the result of the above calculation.

Next place, the label tape 51 is advanced by a distance so that the indication area 55 just passes the detecting position 18*a*. Namely, in a step S3, the driver 45 is controlled and the aforementioned rollers 16 are rotated by the motor 46, advancing the label tape 51 by the calculated distance 27 mm. Since this advance is intended only for feeding mechanically the label tape 51, the tape can be advanced at a high speed such as 40 mm/s (possible to 80 mm/s). This leads to improvement of efficiency. By this advance the label tape 51 is moved from the position in FIG. 4A to that in FIG. 4B.

Next place, the label tape 51 is further advanced and the confirmation step of the cut mark is carried out. For this confirmation step, a first confirmation step of confirming that the front side margin 64 of prescribed length arrives at the detecting position 18*a*, a subsequent second confirmation step of confirming that the cut mark 58 of prescribed length arrives at the detecting position 18*a* and a subsequent third confirmation step of confirming that the rear side margin 63 of prescribed length arrives at the detecting position 18*a* are carried out. In the confirmation step of the cut mark 58, in order that even a small black or colored portion (such as a small letter) and a small blank portion (such as a small blank spot sometimes found in the cut mark), both lying over a very small longitudinal length of the label tape, may be detected, the label tape is advanced repeatedly by a small feed distance appropriate for confirming small length (such as 0.2 mm determined in accordance with the size of possible small colored or blank portions). The average advance speed of the label tape 51 in the confirmation step of the cut mark is, for example, about 20 mm/s. In a step S4, memories M1 through M3 in the memory device 44 are cleared as the initial operation of the above mentioned confirmation step.

The first confirmation step is now carried out as follows. The length of front side margin 64 is measured and it is judged whether this length is within the prescribed interval of length (for example not less than 4 mm and less than 10 mm). Namely, first in a step S5, the driver 45 Is controlled and the motor 46 is rotated by an amount such as 1 step corresponding to the label tape confirming feed length. The label tape 51 is advanced by this rotation by the confirming feed length such as 0.2 mm. Next in a step S6, the detection level of the sensor 18 is checked and it is judged whether the cut mark or an indication similar to it is present or not. When either is not present, 1 is added to the memory M1 in a step S7. Next in a step S8, it is judged whether the advanced distance of the label tape 51 after the step S5, i.e., the distance corresponding to the number stored in the memory M1 exceeds the maximum length (for example 10 mm) of the front side margin 64. When the advanced distance does not exceed the maximum length, the operation is returned to the step S5 and the steps following it are repeated. When the advanced distance of the label tape 51 exceeds 10 mm in the step S8, an error signal is rendered. For example, the operation of the equipment is stopped by the error signal. The label tape 51 is repeatedly advanced by the confirmation feed distance in this manner, arriving at last at the position shown in FIG. 4C and in the step S6 the presence of the cut mark 58 is detected. Next in a step S6', it is judged whether the advanced distance of the label tape 51 after the step S5, i.e., the distance corresponding to the number stored in the memory M1 exceeds the minimum length (for example 4 mm) of the front side margin 64. When the judgment is "YES", the next step is carried out and when the judgment is "NO", an error signal is rendered. When the judgment in the step S6' is "NO", even though the operation is returned to the seep S4 as shown by alternating a long and two short dash lines, the error signal can be ultimately rendered after steps S5 through S8. steps S5, S6 and S6' or steps following a step S9 are repeatedly carried out.

Figure 4A:
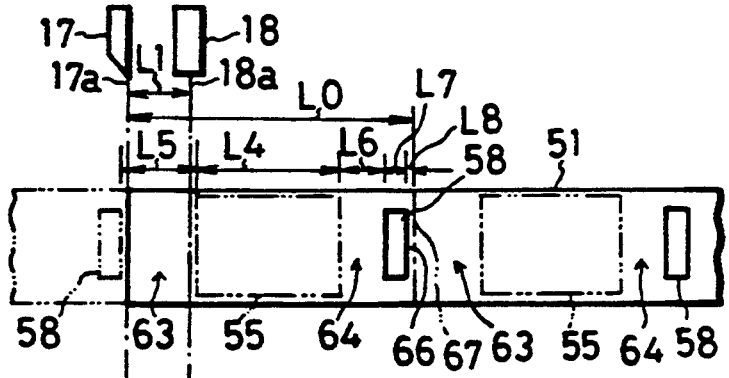
FIGS. 4A through FIG. 4G are plan views for explaining the cutting process of a single label.
Figure 4B:
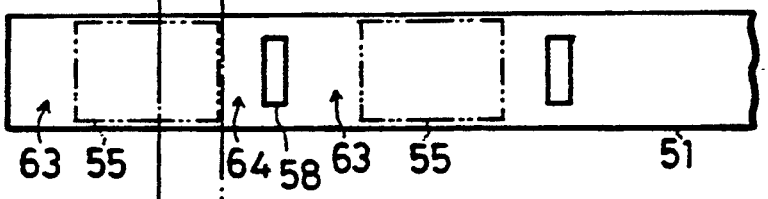
Figure 4C:
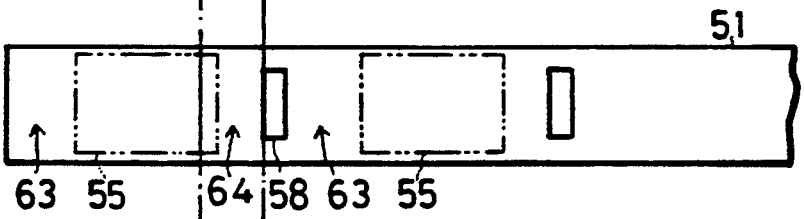
Figure 4D:
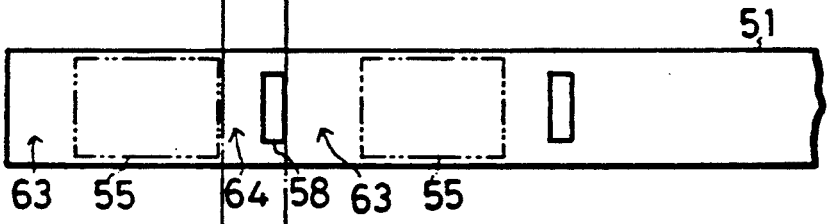

The second confirmation step is carried out as follows. The length of the cut mark 58 is measured and it is judged whether this length is within a prescribed interval of length (for example not less than 1 mm and less than 4 mm). Namely, first in the step S9, 1 is added to the memory M2. Next in a step S10, the label tape is advanced by the confirmation feed distance. Namely, the motor 46 is rotated by one step, advancing the label tape 51 by 0.2 mm corresponding to the one step. Next in a step 11, it is judged whether or not the cut mark 58 is detected by the sensor 18. When it is detected, 1 is added to the memory M2 in a step S12. Next, in a step S13, it is judged whether the advanced distance of the label tape 51 after the step S10, i.e., the distance corresponding to the number stored in the memory, M2 exceeds the maximum length (for example 4 mm) of the cut mark 58. When the advanced distance does not exceed the maximum length, the operation is returned to the step S10 and the steps following the step S10 are repeated. When the distance corresponding to the number stored in the memory M2 exceeds 4 mm in the step S13, an error signal is rendered, informing that a detected object is not a cut mark 58. The steps S10 through S13 are repeatedly carried out, the label tape 51 is repeatedly advanced by the confirmation feed distance, arriving at last at the position shown in FIG. 4D and 1 is added to the memory M3 in a step S14 when the presence of the cut mark 58 is not detected. Next in a step S15, it is judged whether or not the advanced distance of the label tape 51 after the step S10, i.e., the distance corresponding to the number stored in the memory M2, exceeds the minimum length (for example 1 mm) of the cut mark 58. This judgment is done in order to confirm whether the object detected so far is the cut mark 58 or some other indication. When the judgment is "YES", the next step is carried out and when the judgment is "NO", the operation is returned to the step S5.

Figure 4E:
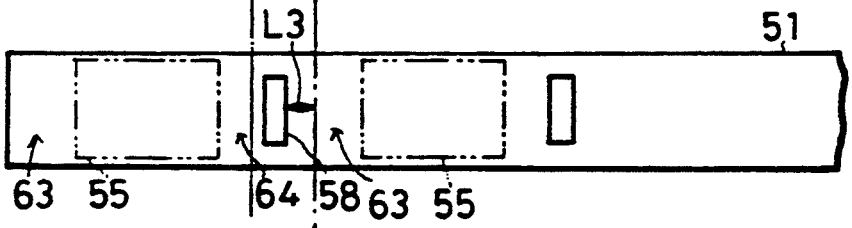

Next, the third confirmation step is carried out as follows. While the label tape 51 is being advanced by the minimum length L3 (for example 5 mm) of the rear side margin 63 as shown in FIG. 4E, it is confirmed that a blank signal is detected at the detecting position 18*a*. Namely, first in a step S16, the label tape 51 is advanced by the confirmation feed distance. Next in a step S17, it is judged whether or not the cut mark 58 or the indication similar to it is detected by the sensor 18. In the case of no detection, 1 is added to the memory M3 in a step S18. Next in a step S19, it is judged whether or not the advanced distance of the label tape 51 after the step S16, i.e., a distance corresponding to the number stored in the memory M3, exceeds the minimum length L3 (for example 5 mm) of the rear side margin 63. When the judgment is "NO", the operation is returned to the step S16 and the steps S16 through S19 are repeated. If the cut mark or the indication is not detected by the sensor 18 until the advanced distance of the label tape 51 amounts to the above mentioned minimum length L3 as shown in FIG. 4E as the result of the repeated steps S16 through S19, the judgment in the step S19 becomes "YES" and the next step is carried out. When it is judged in the step S17 that the cut mark 58 or the indication is detected, a step S25 is carried out. The step S25 is provided so that even though a blank portion 68 as shown in FIG. 7 is present in the cut mark 58 and it leads to the judgment of "NO" in the step S11, the operation may return to the confirmation step of the detection of the cut mark 58 if the blank portion 68 is very small and can be judged as a mere flaw. Accordingly, in this step S25, it is judged whether a distance corresponding to the number stored in the memory M3 is very small, such as less than 1 mm, and when the distance is less than 1 mm, the operation is returned to the step S9 and if this distance is more than 1 mm, an error signal is rendered.

Figure 4F:
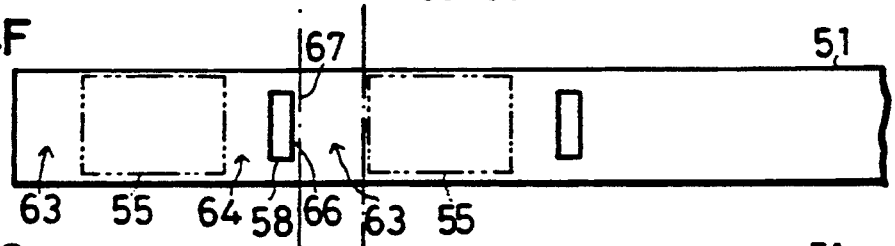

When the arrival of the cut mark 58 is confirmed in the above mentioned manner by a combination of three confirmations, i.e., the confirmation of the arrival of the front side margin 64, the subsequent confirmation of the arrival of the cut mark 58 and the further subsequent confirmation of the rear side margin 63, next the label tape 51 is advanced by a prescribed distance and a portion of it to be cut is brought to the cutting position 17*a*. The label tape is advanced, for example, as follows. First in a step S20, it is judged from the setting in the switch 42 whether the label to be formed is the single label or the folded label. In this case, the set label is the single label. Accordingly, the label tape 51 is advanced in a step S21 so that the portion 67 to be cut behind the portion 66 to be left may arrive at the cutting position 17*a*. Namely, in the step S21, the motor 46 is continuously rotated and the label tape 51 is continuously advanced by a distance (7 mm in this case) equal to the aforementioned length L1 minus the length L3 and plus the length L8 of the portion 66 to be left. Consequently, the label tape 51 is in a situation where the portion 67 to be cut has arrived at the cutting position 17*a* as shown in FIG. 4F. Thus, in a next step S23, the motor 46 is stopped and the label tape 51 ceases to be advanced.

Figure 4G:
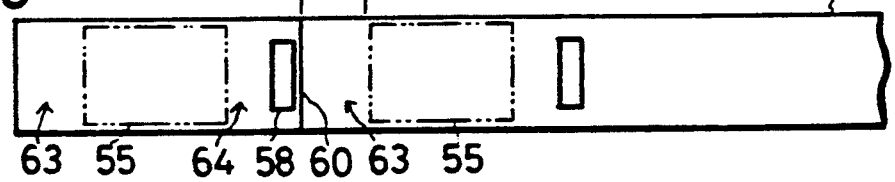
Figure 5A:
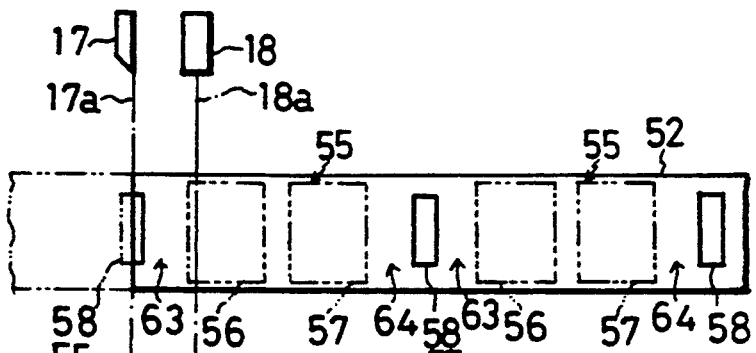
FIGS. 5A through FIG. 5G are plan views for explaining the cutting process of a folding label.
Figure 5B:
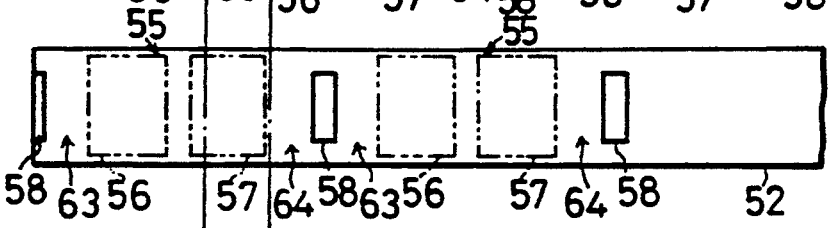
Figure 5C:
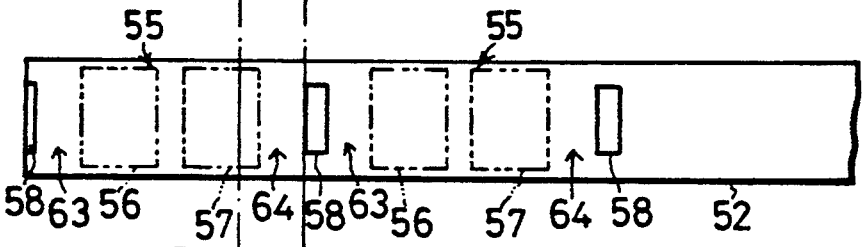
Figure 5D:
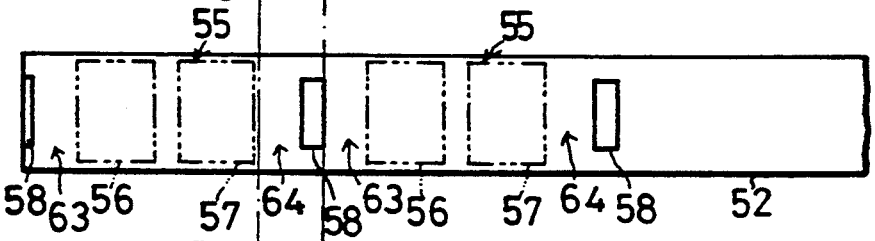
Figure 5E:
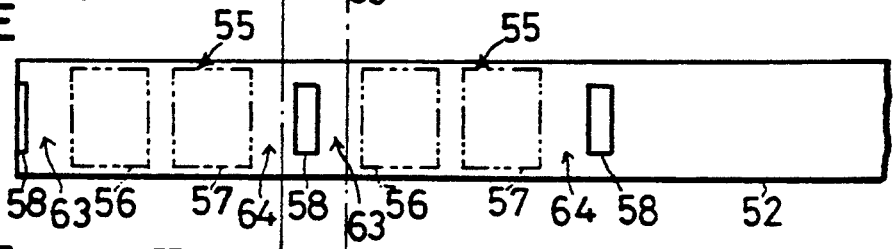
Figure 5F:
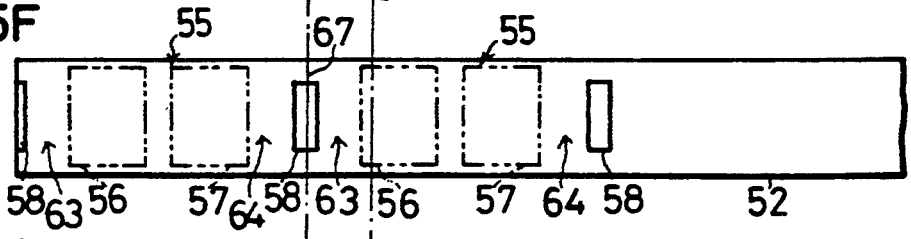
Figure 5G:
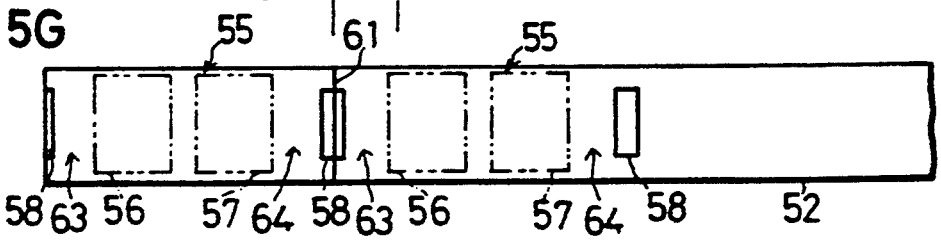

Next in a step S24, the cutter 17 is operated, the label tape 51 is cut at the cutting position 17*a* as shown by numeral 60 in FIG. 4G and a single label 53 is cut off.

Next, the cutting operation of the label element 54 for the folded label 54' is explained with reference to FIGS. 5A through 5G. In this case, the changeover switch 42 is turned beforehand to the side of the folded label. The operation in the steps S1 through S19 is carried out similarly as in the case of the aforementioned single label 53 and the label tape 52 is advanced as shown in FIGS. 5A through 5E. Since the label set beforehand in the step S20 is the folded label, a step S22 is carried out. In the step S22, half the length L7 of the cut mark 58, i.e., half the distance corresponding to the number stored in the memory M2 is subtracted from a distance (for example 6 mm) calculated by subtracting the length L3 from the length L1 and the motor 46 is rotated to advance the label tape 52 by the resultant distance of this subtraction. Consequently, the label tape 52 is in a situation where the middle of the length of the cut mark 58 has arrived at the cutting position 17*a*. Subsequent operation is carried out similarly as in the case of the aforementioned single label and the label tape 52 is cut as shown by a numeral 61 in FIG. 5G, a label element 54 being cut off.

Figure 8A:
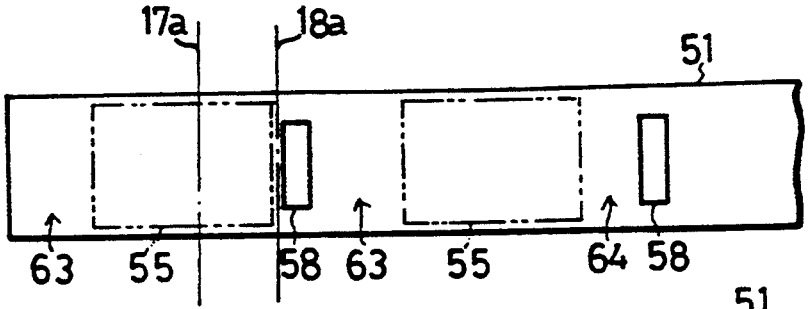
Figure 8B:
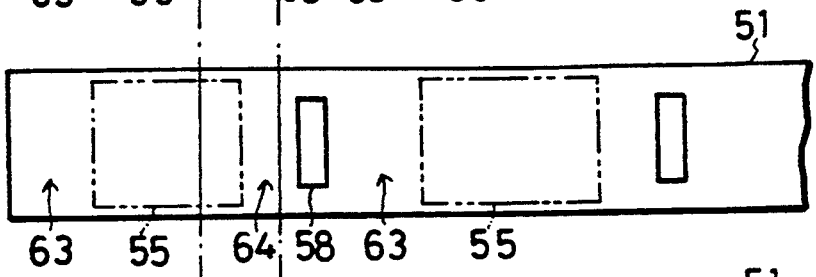
Figure 8C:
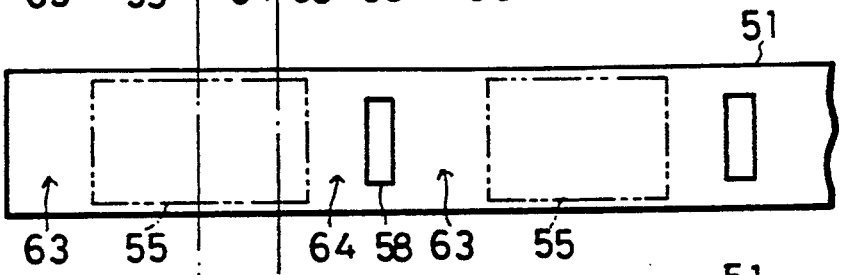

Next, a case is explained where the long label tape 51 has an abnormal portion resulting from the aforementioned misweaving or the improper connection. If the front side margin 64 is absent due to the misweaving or the improper connection as shown in FIG. 8A, if the indication area 55 is shorter due to the misweaving as shown in FIG. 8B and if the indication area 55 is longer due to the misweaving as shown in FIG. 8C, the situations shown in these figures. respectively result when a step is finished when the label tape 51 is advanced by a distance just sufficient for the indication area 55 to pass the detecting position 18*a*. Accordingly, in the first confirmation step, the judgment in the step S6' for any of these situations is "NO" and an error signal is output.

Figure 8D:
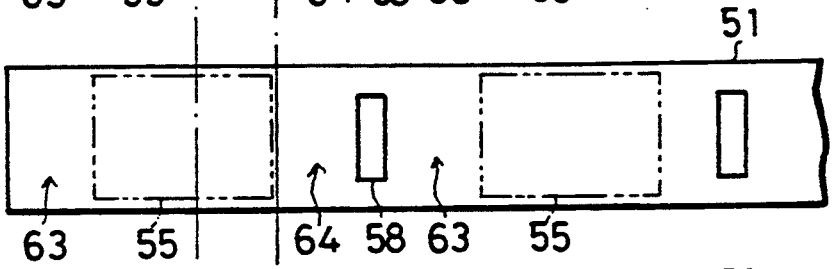

If the front side margin 64 is too long due to the misweaving as shown in FIG. 8D, the situation of this figure results when a step is finished where the label tape 51 is advanced by a distance just sufficient for the indication area 55 to pass the detecting position 18*a*. Accordingly, in the first confirmation step, the judgment in the step S8 becomes "NO" and an error signal is output.

Figure 8E:
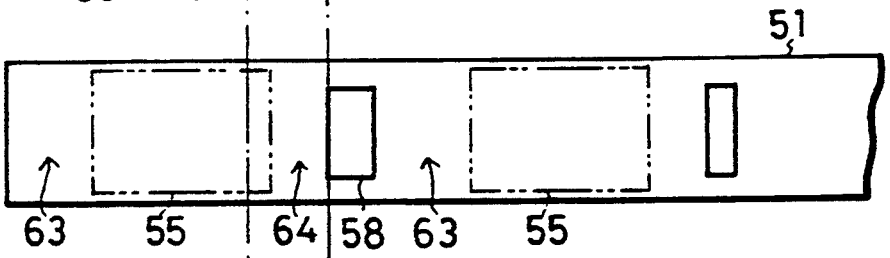

If the cut mark 58 is too long due to the misweaving or the improper connection as shown in FIG. 8E, the situation of this figure results when the first confirmation step is finished. Then in the second confirmation step, the judgment in the step S13 becomes "YES" and an error signal is output.

Figure 8F:
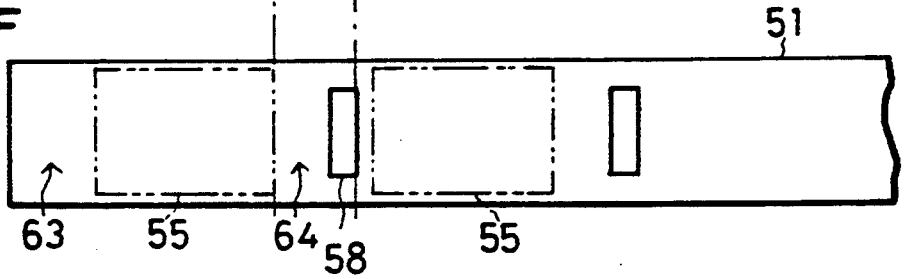

If the rear side margin 63 is absent due to the misweaving or improper connection as shown in FIG. 8F, the situation of this figure results when the second confirmation step is finished. Then in the next or third confirmation step, the judgment in the step S25 becomes "NO" and an error signal is output.

Next, the cut mark 58 may be confirmed only by the second confirmation step when the length of the cut mark 58 is sufficiently long or short as compared with the length of various indications in the indication area 55. The cut mark 58 may be confirmed only by the first and the second confirmation steps when the label tape does not have the rear side margins 63. The cut mark 58 may be confirmed only by the second and the third confirmation steps when the label tape does not have the front side margins 64.

Next, the first confirmation step may be carried out, as well as the third confirmation step, by confirming that a blank signal is continuously detected at the detecting position 18*a* while the label tape is being advanced by the distance equal to the minimum length of the front side margin 64.

The second confirmation step may be carried out as a confirmation step equivalent to the third confirmation step. Namely, the second confirmation step may be carried out by confirming that the cut mark is continuously detected at the detecting position 18*a* while the label tape is being advanced by the distance equal to the minimum length of the cut mark 58.

Furthermore, when the aforementioned length L1 is larger than L5, the third confirmation step may be carried out as well as the first confirmation step by measuring the length of the rear side margin 63 and by confirming that the measured length is within a prescribed interval of length.

Now FIGS. 9 and 10 show a different embodiment of the present invention in which the second confirmation step is different. In this embodiment a cut mark length setter 71 is employed as shown in FIG. 9 and the length (length in the longitudinal direction of the label tape) of the cut mark is set beforehand in the setter. Then, in the second confirmation step, a step S33 is carried out instead of the aforementioned step S13 and a step S35 instead of the step S15 as shown in FIG. 10. In the step S33, it is judged whether or not the advanced distance of the label after the step 10*e*, i.e., a distance corresponding to the number stored in the memory M2, is larger than the beforehand set length W plus a tolerance $\alpha$ such as 10% of W. In the step S35, it is judged whether a distance corresponding to the number stored in the memory M2 is larger than the beforehand set length W minus the tolerance $\alpha$ or not. Those members in these figures which are considered the same as or constructionally equivalent to those in the previous figures are given the same reference numerals with a letter "e" as those of the corresponding previous members and the explanations of the members are not repeated.

What is claimed is:

1. A method of cutting label tapes including the steps of:

(a) advancing a long label tape with a number of cut marks disposed at regular intervals on said tape in a longitudinal direction of said tape, said tape having an indication area between a downstream cut mark and an upstream cut mark for each pair of adjacent cut marks, a rear side margin between said downstream cut mark and said indication area and a front side margin between said upstream cut mark and said indication area, wherein said label tape is advanced along a prescribed advance route in the longitudinal direction of the tape by a distance sufficient for one of said indication areas thereon to pass a detecting position located on said advance route;

(b) further advancing said label tape and confirming advance of a said upstream cut mark to said detecting position by:

(i) confirming that the front side margin of a prescribed length has arrived at said detecting position, and confirming that said upstream cut mark of a prescribed length has arrived at said detecting position;

(c) advancing said label tape by a prescribed distance after confirmation of said upstream cut mark at said detecting position; and (d) then cutting said label tape at a cutting position located on said advance route downstream of said detecting position.

2. The method of cutting label tapes as set forth in claim 1 wherein the step of advancing said label tape after confirmation of said upstream cut mark further includes a third confirmation step of confirming that the rear side margin of a prescribed length has arrived at said detecting position.

3. The method of cutting label tapes as set forth in claim 1 wherein said the step of confirming the arrival of the front side margin is a step of measuring the length of said front side margin and confirming that said length is within a prescribed interval of length.

4. The method of cutting label tapes as set forth in claim 1 wherein said the step of confirming the arrival of the front side margin (b) is a step of confirming that a blank signal is continuously detected at said detecting position while said label tape is being advanced by a distance equal to the minimum length of the front side margin of said label tape.

5. The method of cutting label tapes as set forth in claim 1 wherein said the step of confirming the arrival of said upstream cut mark is a step of measuring the length of said upstream cut mark and confirming that said length is within a prescribed interval of length.

6. The method cutting label tapes as set forth in claim 1 wherein said step of advancing said label tape by said prescribed distance after the confirmation of said upstream cut mark is a step of advancing said label tape by a distance sufficient to bring the center of said upstream cut mark to said cutting position.

* * * * *